US005634404A

United States Patent [19]

Okuda

[11] Patent Number: 5,634,404

[45] Date of Patent: Jun. 3, 1997

[54] STENCIL PRINTING MACHINE

[75] Inventor: Sadanao Okuda, Tokyo, Japan

[73] Assignee: Riso Kagaku Corporation, Tokyo, Japan

[21] Appl. No.: 519,748

[22] Filed: Aug. 28, 1995

[30] Foreign Application Priority Data

Sep. 1, 1994 [JP] Japan ..... 6-208774

[51] Int. Cl.[6] ..... B41L 47/14

[52] U.S. Cl. ..... 101/477; 101/118

[58] Field of Search ..... 101/114, 116, 101/117, 118, 129, 477

[56] References Cited

U.S. PATENT DOCUMENTS

| | | | |
|---|---|---|---|
| 4,628,813 | 12/1986 | Hasegawa et al. | 101/116 |
| 5,048,416 | 9/1991 | Iijima | 101/115 |
| 5,304,836 | 4/1994 | Cheema et al. . | |
| 5,404,805 | 4/1995 | Fujimoto et al. | 101/118 |

FOREIGN PATENT DOCUMENTS

| | | |
|---|---|---|
| 0 642 929 | 3/1995 | European Pat. Off. . |
| 255361 | 7/1926 | United Kingdom . |
| 2 275 227 | 8/1994 | United Kingdom . |

OTHER PUBLICATIONS

Patent Abstracts of Japan, vol. 018, No. 119(M–1567), Feb. 24, 1994 Pat. No. A—05 309932, Pat. Date Nov. 22, 1993, Ricoh Co., Ltd.

Patent Abstracts of Japan, vol. 012, No. 014(M–659), Jan. 16, 1988, Pat. No. A–62 173296, Pat. Date Jul. 30, 1987, Tomoegawa Paper Co., Ltd.

Patent Abstracts of Japan, vol. 009, No. 206(M–406), Aug. 23, 1985, Pat. No. A–60 067196, Pat. Date Apr. 17, 1985, Zeneraru KK.

*Primary Examiner*—Ren Yan

*Attorney, Agent, or Firm*—Kanesaka & Takeuchi

[57] ABSTRACT

A stencil printing machine is formed of a perforating section for perforating a stencil sheet produced by bonding a resin film to a substrate with an adhesive; a printing drum on the outer peripheral surface of which the stencil sheet perforated at the perforating section is wrapped with the resin film inside, and, after removal of a substrate from the stencil sheet thus wrapped, printing is done by passing ink supplied to an inner peripheral surface, through the perforated portion of the resin film remaining on the outer peripheral surface; an pressing member for pressing printing paper against the printing drum during printing; a separating device for separating and discharging the substrate from the stencil sheet wrapped around the printing drum, prior to starting printing; and a resin film removing section for removing the resin film of the stencil sheet from the printing drum after completion of printing.

3 Claims, 4 Drawing Sheets

FIG. 6

| | PERCENTAGE OF ACTUALLY SOLID-PRINTED AREA | QUANTITY RECEIVED IN STENCIL DISCHARGE SECTION |
|---|---|---|
| STENCIL PAPER OF THE PRESENT INVENTION | 99.8 | 1310 |
| CONVENTIONAL STENCIL PAPER | 70.8 | 60 |

STENCIL PRINTING MACHINE

BACKGROUND OF THE INVENTION

The present invention relates to a stencil printing machine.

There has been known such a stencil sheet as is produced by bonding a resin film and a multi-porous substrate made of a multi-porous sheet with an adhesive.

This stencil sheet is prepared by perforating the film section by the use of a heat source such as a thermal head, and then is wrapped around a printing drum with the multi-porous substrate inside. Then, printing is done by passing ink through the stencil sheet to a printing paper.

In this type of printing using the above-described stencil printing machine, however, the multi-porous substrate itself has low perviousness to ink, resulting in ununiform ink transfer to a printing paper, that is, in an ununiformly printed image. This is because the multi-porous substrate produced of a multi-porous sheet has uneven density and thickness.

To make ink ununiformly transferred to paper look as if uniform, it is necessary to spread ink from the portion where ink has passed into the printing area of the paper, to the portion where no ink has been transferred. Thus spreading ink, however, will result in the presence of an excessive amount of ink within the printed area on the printing paper where ink passes through, and accordingly in ink offset and strike-through.

As a means for improving the ununiform ink condition on paper, there is used only a resin-film stencil for printing, that is, without using the multi-porous sheet substrate. In this case, the stencil sheet can not be conveyed in the machine, and is wrinkled in stencil preparation or when wrapped around the printing drum, and accordingly printed matter faithful to an original master copy is unobtainable. Such a technology has been disclosed in Japanese Patent Laid-Open No. Hei 5-220919.

The stencil sheet produced by bonding a conventional resin film and a porous substrate such as a porous sheet with an adhesive is generally of the order of 30 to 50 μm in thickness.

Therefore, for discharging the stencil sheet of this thickness by means of the stencil discharge section provided within the stencil printing machine, space as this thickness is needed. In this case, however, a limited quantity of discharged stencils is around 20 to 100, albeit it depends on the discharge system and capacity, and the discharge section is not capable of accommodating a large quantity of spent stencils.

Furthermore, the substrate such as the multi-porous sheet of the stencil sheet to be discharged to the stencil discharge section contains a large amount of ink; that is, ink is used wastefully.

By the way, the prior art technique for printing by the use of only a perforated resin-film stencil has been disclosed in Japanese Patents Laid-Open No. Hei 5-309932 and No. Hei 5-318900. According to the technique of Japanese Patent Laid-Open No. Hei 5-309932, a resin film and a substrate that have been separated are stripped off at the stencil discharge apparatus and received in a common receiving box. Therefore, the quantity of stencil paper discharged makes no difference from that of the stencil sheet made by bonding the prior art resin film and a multi-porous substrate of a multi-porous sheet with an adhesive.

According to the technique disclosed in Japanese Patent Laid-Open No. Hei 5-318900, the separated porous substrate is held inside the machine and accordingly the a space large enough to hold the porous substrate within the machine is required.

For printing by the use of a prior art stencil sheet made by bonding a resin film and a multi-porous substrate such as a multi-porous sheet with an adhesive, the stencil sheet is wrapped around the printing drum. At this time, if a perforated resin film which is on the outer side of the stencil sheet is impressed, ink passes through the perforated portion of the resin film, smearing the pressed member. Therefore, the stencil sheet, when wrapped around the printing drum, can not be impressed, and accordingly it is necessary to wrap the stencil sheet around the printing drum by using an impressing member with the printing paper inserted between the printing drum and the impressing member.

Furthermore, for fully impregnating a stencil sheet with ink from a multi-porous substrate such as a multi-porous sheet to a perforated resin film, a considerable pressure and/or impression time are required, resulting in excessive ink transfer to the printing paper used in wrapping the stencil sheet around the printing drum.

When printing is continuously performed immediately after the wrapping of the stencil sheet around the printing drum, the printing paper used in wrapping the stencil sheet is discharged onto a discharge tray, on which succeeding paper is stacked continuously. Since a large amount of ink remains on the paper used in wrapping, ink will transfer to the back side of the paper discharged thereon. The paper used in wrapping is a printed matter not faithful to the original master copy because of presence of such a defect as excessive strike-through. That is, the printing paper is used wastefully.

Furthermore, when the stencil sheet is wrapped around the printing drum with a decreased pressure and/or impression time required for wrapping around the printing drum, the first one to three printing sheets are not fully impregnated with ink, resulting in a failure in producing a printed matter faithful to an original master copy.

SUMMARY OF THE INVENTION

It is an object of the present invention to provide a stencil printing machine which is capable of smoothly conveying the stencil sheet, obtaining quality images, and remarkably increasing the discharged stencil sheet receiving capacity in a specific volume.

The stencil printing machine according to the first aspect of the present invention has a stencil perforating section for perforating a stencil sheet made by bonding a resin film and a substrate with an adhesive; a printing drum for printing by passing ink supplied to the inner peripheral surface, through the perforated section of the resin film remaining in the outer peripheral surface after the stencil sheet prepared at the stencil perforating section is wrapped around the outer peripheral surface of the printing drum with the resin film inside and then the substrate is removed from the stencil sheet that has been wrapped; a pressing member for pressing printing paper, against the printing drum; a separating means for separating and discharging the substrate from the stencil sheet wrapped around the printing drum, before starting printing; and a stencil discharge section for removing the resin film of the stencil sheet from the printing drum after completion of printing.

In the stencil printing machine according to the second aspect of the present invention, the separating means in the stencil printing machine of the first aspect has also a function to separate inked paper from the printing drum.

In the stencil printing machine according to the third aspect of the present invention, the substrate of the stencil sheet used in the stencil printing machine of the first aspect has a cut made along a direction intersecting with the direction of rotation of the printing drum and a plurality of holes formed at a specific spacing along the direction of rotation of the printing drum. The separating means stated above is a rotatable roller provided with a plurality of engaging members which engage with the holes of the substrate; the engaging member of the roller is engaged with the holes of the substrate of the stencil sheet wrapped around the outer peripheral surface of the printing drum, thereby rotating the roller to cur off the substrate at the cut from the resin film.

The stencil sheet according to the fourth aspect of the present invention is produced by separably bonding the resin film with an adhesive to an ink-receptive sheet as the substrate, said ink-receptive sheet being capable of being printed with said ink.

In the stencil sheet according to the fifth aspect of the present invention the adhesive stated above in the stencil sheet of the fourth aspect is a thermoplastic resin adhesive which is dissolved or swollen with a component in the printing ink.

The stencil sheet is wrapped around the printing drum with the perforated resin film inside and with the ink-receptive sheet outside. When wrapping the stencil sheet, a pressure is applied by the pressing member from the ink-receptive side, and thereafter the ink-receptive sheet of the stencil sheet is separated by the substrate separating part.

To this ink-receptive sheet thus separated, ink is transferred through the perforated portion of the resin film to print an image, thus making a test printing. It is, therefore, unnecessary to use a printing paper P for the purpose of test printing at the time of wrapping the stencil sheet on the printing drum. That is, an printed image has been formed on the ink-receptive sheet discharged out of the stencil printing machine, from which the fidelity of the perforated stencil sheet to the original master copy can be ascertained.

After the separation of the ink-receptive sheet, only the perforated resin film remains on the printing drum and is used for actual printing.

Therefore, since there is used no multi-porous substrate that formerly gave an adverse effect to printing, it is possible to obtain a printed matter which is faithful to the original copy.

After completion of printing, the stencil discharge section for removing the resin film from the printing section is required to receive only a very thin resin film, and consequently the discharge stencil sheet receiving capacity in a specific volume can be remarkably improved.

The above and other objects, aspects and advantages will become apparent to those skilled in the art by the preferred embodiment consistent with the principle of the invention, which will be discussed and illustrated in connection with the accompanying drawings.

BRIEF DESCRIPTION OF THE DRAWINGS

FIG. 6 is a comparison table for comparing the effect of the present embodiment with that of a prior art example.

DETAILED DESCRIPTION OF THE PREFERRED EMBODIMENT

Hereinafter an embodiment of a stencil printing machine according to the present invention and a stencil sheet to be used in the same machine are explained.

Figure 1:
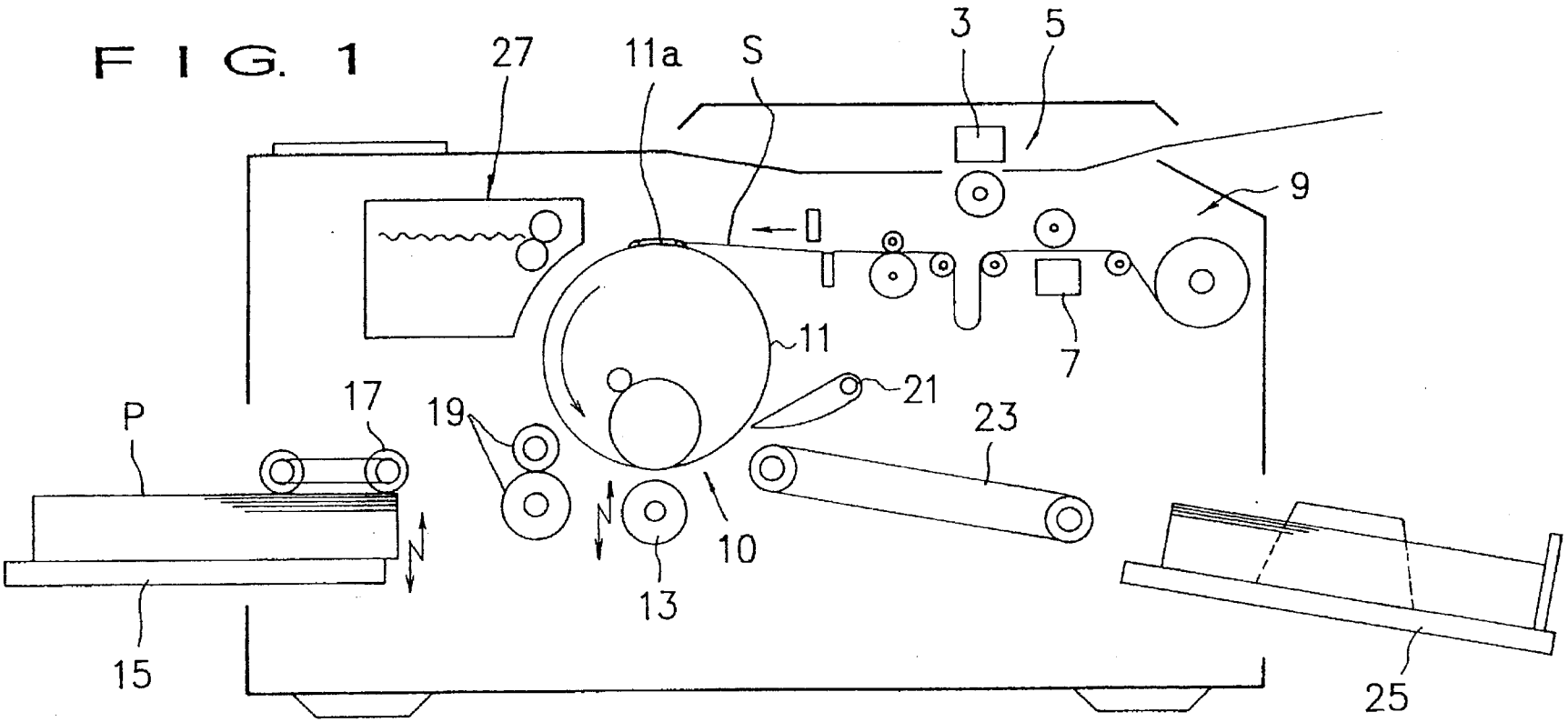
FIG. 1 is a schematic view of a stencil printing machine of the present invention.

FIG. 1 is a schematic view of the stencil printing machine of the present invention.

The stencil printing machine is provided with an original image reading section 5 including an image scanner 3, for reading an image of an original master copy to be printed; and a stencil perforating section 9 having a stencil perforating device 7 for duplicating an image by perforating a stencil sheet S in accordance with an original image data read by the original image reading section 5.

The stencil perforating device 7 adopts a perforating system using a thermal head or other to prepare the stencil sheet S. The shape of perforation is preferably independent by each dot, but each dot is unnecessarily fully independent. The stencil sheet is demanded to have a good printing resistance to withstand a tearing force during printing and can be smoothly conveyed to a stencil discharge section 27 described later.

It should be noticed that the stencil sheet S perforated to a normal image by a stencil perforating section 9 is sufficient. Also it should be noted that, in the present invention, the stencil sheet S rolled as illustrated is fed out successively and cut to a specific length after being perforated by the perforating device, but the stencil sheet S may be fed in a form of sheets which will be used one by one by each stencil preparation.

The stencil sheet S, after preparation, must be stably conveyed to a printing section 10. Since a perforated resin film S2 is integral with the ink-receptive sheet which is a substrate of the stencil sheet, the stencil sheet will never be wrinkled at the time of stencil perforation and wrapping around a printing drum 11.

The resin film S2 thus perforated by the stencil perforating section 9 is mounted, integrally with the ink-receptive sheet S1, around the outer peripheral surface of the printing drum 11 in the printing section 10. At this time, the stencil sheet S is wrapped with the resin film S2 on the printing drum 11 side. This wrapping is done by rotating the printing drum 11 in the direction of the arrow in the drawing with the leading edge of the stencil sheet S securely clamped with a clamper 11*a*.

Figure 2:
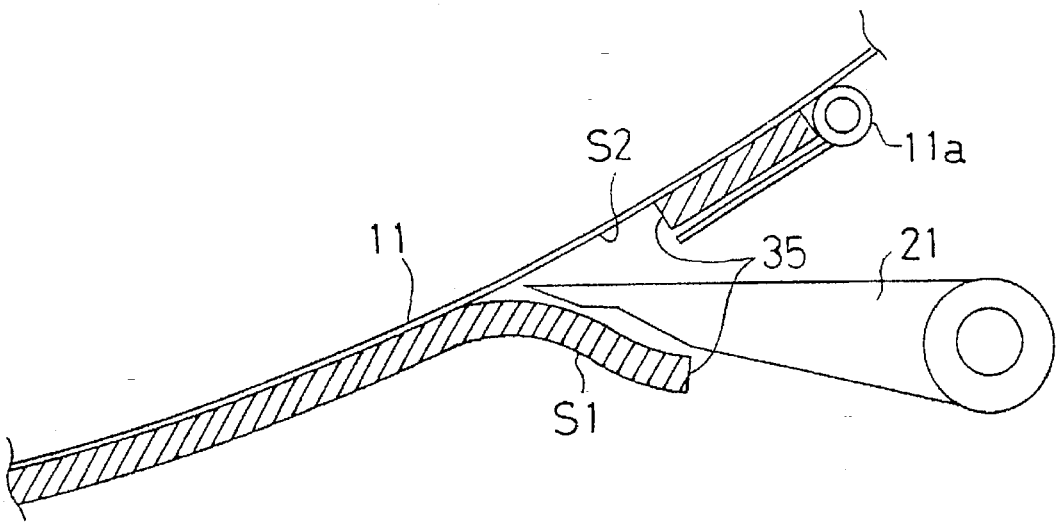
FIG. 2 is a view showing a fragmentary sectional view of the stencil printing machine of the present invention.

The stencil sheet S, when wrapped, is simultaneously pressed against the printing drum 11 side by means of an impressing member 13, thus completing the installation of the stencil sheet on the printing drum 11. Thereafter the ink-receptive sheet S1 is separated from the resin film by the substrate separating section, and discharged out of the machine. For this substrate separating section, an existing separating pawl 21 is usable as the printing paper separating section as shown in FIG. 2. In the present embodiment, the ink-receptive sheet S1 is discharged out of the machine by this separating pawl, not by a special support separating section.

The printing drum 11 after the separation of the ink-receptive sheet Sl carries only the resin film S2 and is ready for printing on the printing paper P immediately by the use of the impressing member 13. At this time, no multi-porous substrate which will give an adverse effect to printing is in use, and the resin film S2 alone is present on the printing drum 11. It is, therefore, possible to obtain a printed matter faithful to the original master copy.

The printing paper P is fed out from the paper feed table 15. After being fed out one by one by means of the paper feed roller 17, the paper is fed in at a specific timing by the paper feed timing roller 19 between the printing drum 11 and the impressing member 13.

With the rotation of the printing drum 11, printing is done on the printing paper P, correspondingly to the image perforated on the stencil sheet S, with the pressure of the impressing member 13.

The printing paper P is separated from the printing drum 11 by means of a separating pawl 21 as a printing paper separating section, and conveyed by a belt conveyor system of a delivery apparatus 23 to be discharged out to a paper receiving tray 25.

In the case of a roll-type stencil sheet S, the ink-receptive sheet S1 should be designed to be easily separable; for example, there should be provided a separating portion in other than a perforable area, so that the ink-receptive sheet S1 can easily be separated thereat.

Furthermore, after the completion of printing, the resin film S2 of the stencil sheet S wrapped around the printing drum 11 is stripped from the printing drum 11 by means of the stencil discharge section 27 having the discharge pawl, discharge roller, etc. for discharging the stencil sheet S to be discharged into a stencil discharge box.

Since the ink-receptive sheet S1 is used as a substrate, a molten component resulting from the perforation of the resin film S2 at the perforating section 9 permeates to the interior of the ink-receptive sheet S1. Therefore, the stencil sheet S having a low adhesive power increases in the adhesive power at the perforated portion more than at the unperforated portion.

However, in the portion increased in the adhesive power by perforation, ink is permeated into the interior of the ink-receptive sheet S1 by the pressure of the impressing member 13, dissolving and/or swelling the molten component resulting from perforation, and therefore the adhesive power in the perforated portion decreases to facilitate the separation of the perforated resin film S2 from the ink-receptive sheet S1.

Forming a separating section 35 in a fixed position from the edge of the ink-receptive sheet S1 of the stencil sheet S is effective. This separating section 35 facilitates the separation of the ink-receptive sheet S1 from the resin film S2. As a method for providing this separating section 35, perforations are formed. The length of the perforations nearly agrees with the width of the clamper 11*a* as shown in FIG. 2. Also, the separating section 35 may have been fully cut. Furthermore, the ink-receptive sheet S1 may be a sheet similarly designed for easy separation.

The condition of a printed image on the paper evaluated by using an image analyzer on a whole solid-printed portion is shown in the table of FIG. 6.

As an example of comparison is used a conventional stencil sheet S produced by attaching the resin film S2 to the multi-porous sheet S1. Figures of high values used in the table indicate printed matter faithful to the original master copy; that is, figures of low values indicate printed matter of low fidelity to the original master copy.

In FIG. 1, a stencil discharge section 27 is disposed on the opposite side of the stencil perforating section 9; on the printing drum 11 only the perforated resin film S1 is present, and therefore only the extremely thin resin film S1 is received in the stencil discharge section.

Also shown in FIG. 6 is the quantity of discharged stencil papers received in the stencil discharge section 27, the holding capacity of which is 2.0 liters and is evaluated by a compression-type stencil discharge apparatus.

As an example of comparison is used a conventional stencil sheet S produced by attaching the resin film S2 to the multi-porous sheet S1. Figures of high values used in the table indicate a large discharge stencil holding capacity, while figures of low values indicate a small discharge stencil holding capacity.

By the way, in the present invention is used the ink-receptive sheet S1 as a substrate of the stencil sheet S. If an ink-unreceptive sheet is used, ink on the sheet that has been discharged out of the stencil printing machine will not permeate into the sheet but will remain on the sheet surface.

if the operator holds the discharged ink-unreceptive sheet by hand, his hands will be smeared with ink. The ink-receptive sheet is not limited and may be any type of sheet pervious to printing ink such as a quality printing paper or a synthetic resin sheet, cloth, and unwoven cloth which has been so processed as to be ink-receptive.

Furthermore, if a colored ink-receptive sheet is used, it can be realized from the printing paper P when discharged out of the machine, and also is usable as a tape sorter in order to sort the types of printing papers that have been stacked.

For the resin film S2 of the stencil sheet S of the present invention, a thermoplastic resin film perforated by a heat source like a thermal head, is used, for example, polyethylene, polypropylene, polyvinyl chloride, polyvinylidene chloride, polyester, polystyrene, polyurethane, polycarbonate, acrylic resin, silicone resin, etc., of which particularly the poly-vinylidene chloride and polyester are desirable for use.

It is also possible to use a resin film which is perforable by dissolving by an ink jet system other than the heat source such as the thermal head.

For the adhesive for bonding the resin film S2 of the stencil sheet S of the present invention to the substrate for supporting the resin film S1, a thermoplastic adhesive is used.

For example, polyethylene, polypropylene, polyvinyl chloride, polyvinylidene chloride, polyester, polystyrene, polyurethane, polycarbonate, acrylic resin, and silicone resin are usable. Of these, a material which is dissolved and/or swollen by a component of the printing ink used in the stencil printing machine must be selected.

When the ink-receptive sheet is separated by using an adhesive material, which is not dissolved and/or swollen with the component of ink, for bonding the resin film to the ink-receptive sheet, the adhesive power required for bonding the resin film of the stencil sheet S of the present invention to the substrate supporting the resin film must be so weak as to allow easy separation of the resin film from the substrate supporting the resin film.

Figure 3:
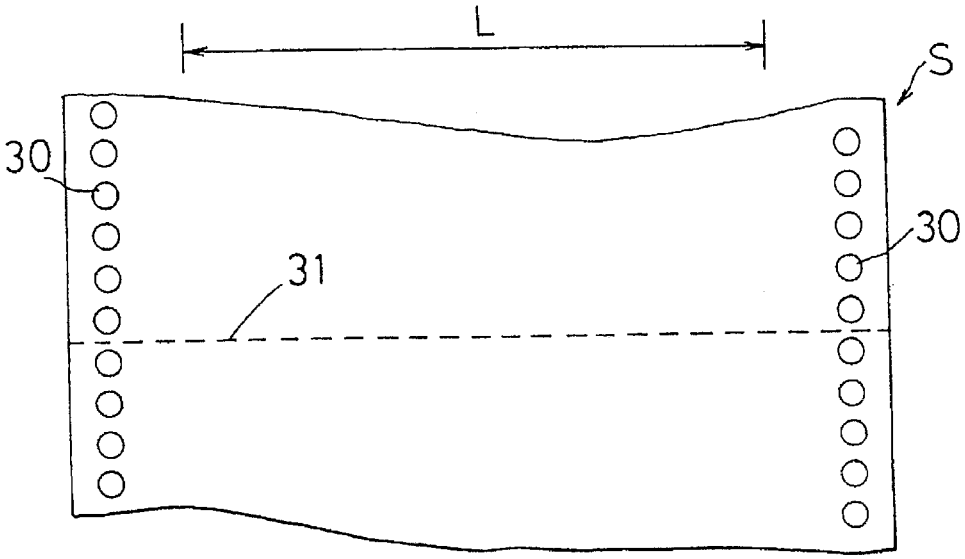
FIG. 3 is a view showing another example of a stencil sheet of the present invention.

Next, FIG. 3 shows another example of the stencil sheet of the present invention.

The stencil sheet S, as illustrated, is a continuous body having a plurality of perforations 30 at a specific spacing at both ends. And the ink-receptive sheet S1 is provided with perforations 31 at a specific spacing.

The printable area of the resin film S1 is to be a range L not extending to the perforations 30.

The stencil sheet S is received in a rolled state in the stencil perforating section 9, and is sent out to the printing drum 11 side while being perforated similarly to the above-described embodiment.

Figure 4:
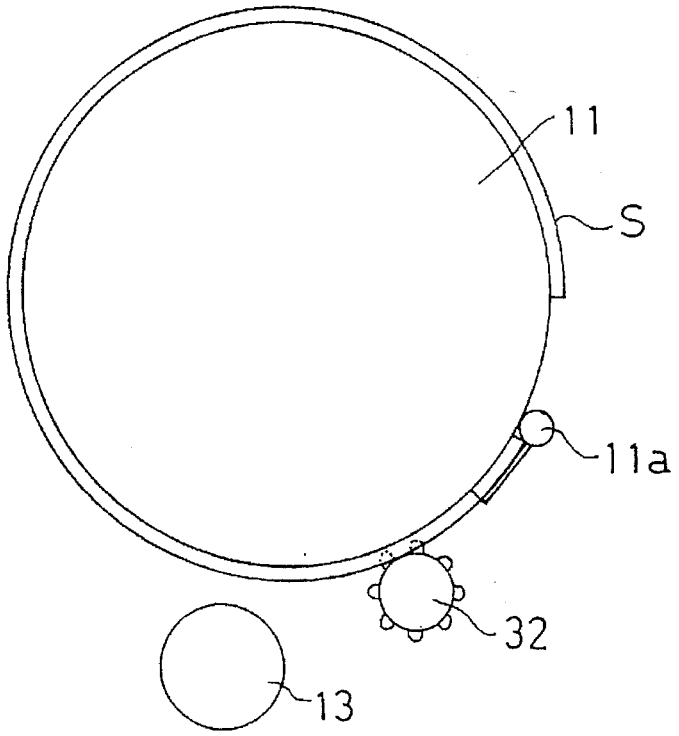
FIG. 4 is a fragmental view of the stencil printing machine.

The stencil sheet S is discharged by the stencil printing machine partly shown in FIG. 4.

Figure 5:
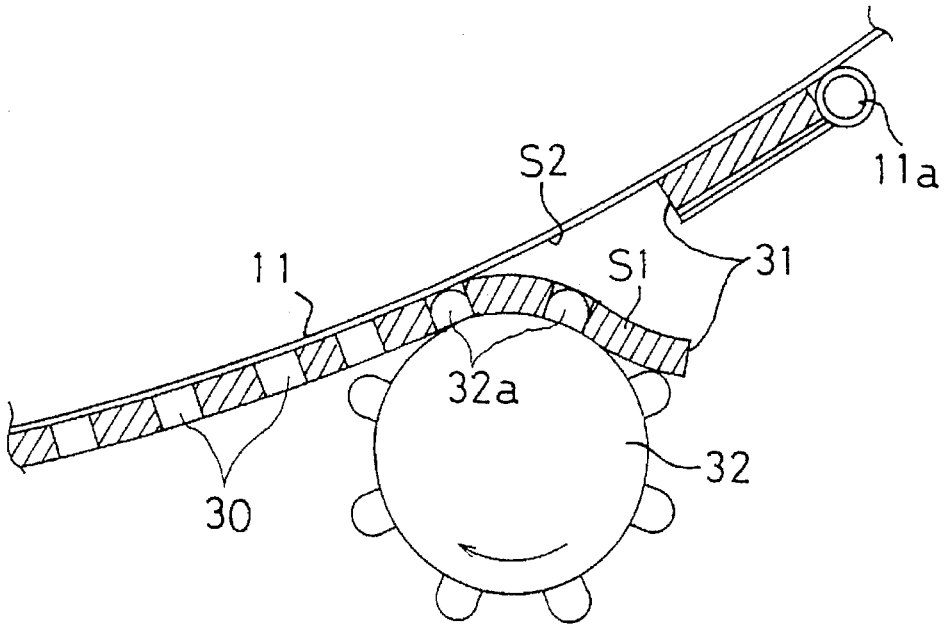
FIG. 5 is an enlarged view of FIG. 4.

In the lower part of the printing drum 11 is provided a feed roller 32 near the separating pawl 21. This feed roller 32 has engaging pawls 32*a* which engage with the perforations 30 as shown in the enlarged view of FIG. 5. The engaging pawls 32*a* are arranged at the same spacing as the pitch of the perforations 30.

Therefore, the stencil sheet S after perforation is secured at the leading edge with the clamper 11*a*, and wrapped as far as the position shown in the drawing around the printing drum 11 with the rotation of the printing drum 11. Then, with the rotating drum 11 rotating, the feed roller 32 is turned in the direction of the arrow in the drawing, thereby separating the ink-receptive sheet S1 at the perforations 31 from the printing drum 11 and the resin film S2. Thus the stencil sheet S can easily be sent out and discharged.

According to the stencil printing machine of the present invention, the perforated resin film, which is integral with the ink-receptive sheet which is a substrate, can be conveyed with stability without wrinkling at the time of perforation and wrapping around the printing drum.

The ink-receptive sheet which is a substrate of the stencil sheet is separated from the resin film by means of the substrate separating section and discharged out of the stencil printing machine. Therefore, in the stencil discharge section for holding the resin film of the stencil sheet removed after printing from the printing section, only the resin film is discharged, thereby enabling to remarkably increase the capacity for holding discharged stencil papers in a specific volume.

Furthermore, as only the perforated resin film is wrapped around the printing drum and printed, printed matter faithful to the original copy are obtainable.

Furthermore, according to the stencil printing machine, since the constitution of an existing printing paper separating section is usable for separation and discharge of the printing paper, the substrate can be discharged out of the machine, thus enabling the simplification of the machine itself.

Furthermore, according to the stencil sheet of the present invention, the ink-receptive sheet which is a substrate is used and discharged out of the stencil printing machine, and therefore the fidelity of the perforated stencil sheet to the original copy can be ascertained. Consequently, no printing paper will be wasted by test printing.

Furthermore, according to the stencil sheet, since the ink-receptive sheet is used as the substrate, a component dissolved at the time of perforation of the resin film permeates into the interior of the ink-receptive sheet; however, because the component thus permeating is dissolved and/or swollen with a component in the ink, the perforated film can easily be separated from the ink-receptive sheet, thus enabling the provision of a highly reliable printing machine.

What is claimed is:

1. A stencil printing machine for printing sheets by a stencil sheet formed of a resin film and a substrate, comprising:

a perforating section for perforating the stencil sheet to have a perforated portion;

a printing drum having outer and inner peripheral surfaces, on the outer peripheral surface of which said stencil sheet perforated at said perforating section is wrapped with said resin film inside, and, after removal of the substrate from said resin film thus wrapped, printing being started by passing ink supplied to the inner peripheral surface, through the perforated portion of said resin film remaining on said outer peripheral surface;

a pressing member for pressing the sheets one by one against said printing drum during printing;

separating means for separating and discharging said substrate wrapped around said printing drum prior to starting printing, said separating means having a function for separating the sheets one by one from the printing drum after printing; and a resin film removing section for removing said resin film from said printing drum after completion of printing.

2. A stencil printing machine for printing sheets by a stencil sheet formed of a resin film and a substrate, said substrate having a plurality of holes at a predetermined interval along at least one side thereof and a cut perpendicular to one side thereof, comprising:

a perforating section for perforating the stencil sheet to have a perforated portion;

a printing drum having outer and inner peripheral surfaces, on the outer peripheral surface of which said stencil sheet perforated at said perforating section is wrapped with said resin film inside, and, after removal of the substrate from said resin film thus wrapped, printing being started by passing ink supplied to the inner peripheral surface, through the perforated portion of said resin film remaining on said outer peripheral surface;

a pressing member for pressing the sheets one by one against said printing drum during printing;

separating means for separating and discharging said substrate wrapped around said printing drum prior to starting printing, said separating means being a rotatable roller having a plurality of engaging members which engage with the holes of the substrate so that the substrate is torn off at the cut and separated from the resin film by rotating the roller; and a resin film removing section for removing said resin film from said printing drum after completion of printing.

3. A stencil printing machine according to claim 2, further comprising a clamper fixed on the printing drum, said resin film and the substrate being clamped onto the printing drum by the clamper.

* * * * *